US010852098B1

(12) United States Patent
Wei

(10) Patent No.: US 10,852,098 B1
(45) Date of Patent: Dec. 1, 2020

(54) TOY GUN WITH A TOGGLEABLE GRIP

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 16/679,213

(22) Filed: Nov. 10, 2019

(51) Int. Cl.
*F41B 11/70* (2013.01)
*F41B 11/89* (2013.01)
*F41B 11/723* (2013.01)

(52) U.S. Cl.
CPC ..... *F41B 11/70* (2013.01); *F41B 11/723* (2013.01); *F41B 11/89* (2013.01)

(58) Field of Classification Search
CPC ..... F41B 11/70; F41B 11/723; F41B 11/89; F41B 11/62; F41B 11/641; F41B 11/64; F41B 11/681; F41B 11/683
USPC ..... 124/70–77
See application file for complete search history.

(56) References Cited

U.S. PATENT DOCUMENTS 1,097,244 A * 5/1914 LeFever ..... F41B 7/006 124/27
2,321,076 A * 6/1943 Gora ..... F41B 7/003 124/16
3,782,359 A * 1/1974 Kester ..... F41B 11/62 124/48
4,665,885 A * 5/1987 Glomski ..... F41B 7/003 124/27
5,284,274 A * 2/1994 Lee ..... F41B 9/0065 124/65
5,339,791 A * 8/1994 Sullivan ..... F41B 11/00 124/73
5,381,928 A * 1/1995 Lee ..... F41B 9/0031 124/65
5,383,442 A * 1/1995 Tippmann ..... F41A 29/02 124/73
5,515,837 A * 5/1996 Nin ..... F41B 11/723 124/59
9,004,052 B1 * 4/2015 Poirier ..... F41B 7/08 124/27
9,784,524 B1 * 10/2017 Ma ..... F41B 7/08
2006/0032487 A1 * 2/2006 Tippmann, Sr. ..... F41B 11/723 124/74
2006/0191523 A1 * 8/2006 Paletz ..... F41B 11/646 124/67
2007/0062510 A1 * 3/2007 Broersma ..... F41B 11/62 124/74

(Continued)

FOREIGN PATENT DOCUMENTS

WO WO-9212395 A1 * 7/1992 ..... F41B 11/62

*Primary Examiner* — John Cooper
(74) *Attorney, Agent, or Firm* — Chun-Ming Shih; HDLS IPR Services

(57) ABSTRACT

A toy gun with a toggleable grip includes a gun body, an air switch valve, a hammer assembly, a delivery tube, and a trigger assembly. The gun body has a barrel and a magazine. The hammer assembly includes a hammer and a return spring flexibly held between the gun body and the hammer. The hammer can selectively push against or release the air switch valve. The delivery tube has a toggleable grip and a push element. The push element can be selectively pushed against the hammer or crammed between the barrel and the magazine. The trigger assembly includes a trigger member and a hammer latch, both pivoted to the gun body. The trigger member can drive the hammer latch to press against or release the hammer.

10 Claims, 10 Drawing Sheets

(56) References Cited

U.S. PATENT DOCUMENTS

| | | | | |
|---|---|---|---|---|
| 2011/0041821 | A1* | 2/2011 | Brown | F41B 7/08 124/27 |
| 2011/0146645 | A1* | 6/2011 | Ma | F41B 11/54 124/59 |
| 2011/0186027 | A1* | 8/2011 | Casas Salva | F41A 17/82 124/74 |
| 2012/0080019 | A1* | 4/2012 | Victor | F41B 7/003 124/16 |
| 2012/0125304 | A1* | 5/2012 | Brooks | F41B 7/003 124/52 |
| 2014/0130787 | A1* | 5/2014 | MacY | F41B 11/51 124/73 |
| 2018/0080735 | A1* | 3/2018 | Zhu | F41B 11/683 |
| 2018/0156566 | A1* | 6/2018 | Wei | F41B 11/89 |

* cited by examiner

TOY GUN WITH A TOGGLEABLE GRIP

BACKGROUND OF THE INVENTION

Field of the Invention

The present invention relates to a toy gun structure, and in particular, to a toy gun with a toggleable grip.

Description of Prior Art

Modern people suffer from quite busy work under great stress. Thus, many of them choose to do leisure activities to release daily accumulated pressure. At the same time, more and more people try to find some leisure activities, fresh and exciting. Consequently, the toy gun like the BB gun or paintball gun has become one of the important tools of shooting training for people.

There are commonly two kinds of auxiliary grips of a gun, the foregrip and the reargrip, which are mainly used for the machine gun, automatic rifle, sniper rifle, and submachine gun. In particular, the vertical foregrip mounted on the gun and moveable laterally can further enable a stable shooting and mitigate the recoil force.

However, the currently available toy gun with the vertical foregrip in the market usually adopts a fixed mounting to the barrel, which shows a dramatic difference between the toy gun and the real gun in appearance and operation of the foregrip. Therefore, how to design a vertical foregrip having a realistic structure is an important aspect the inventor does research on.

In view of this, the inventor pays special attention to research with the application of related theory and tries to improve and overcome the above disadvantages regarding the above related art, which becomes the development goal of the inventor.

SUMMARY OF THE INVENTION

The present invention provides a toy gun with a toggleable grip, which uses a toggleable grip which is moveable back and forth with respect to the barrel and an push element which can selectively push against the hammer or the bullet to the barrel such that the appearance and operation of the toggleable grip are similar to that of the vertical foregrip of a real gun and thus the toy gun of the present invention has very realistic features.

In an embodiment, the present invention provides a toy gun with a toggleable grip, used with an air bottle and a cartridge. The toy gun includes a gun body, an air switch valve, a hammer assembly, a delivery tube, and a trigger assembly. The gun body has a barrel, an air chamber connected to the barrel, and a magazine connected to the barrel. The air bottle is disposed in the air chamber and the cartridge is disposed in the magazine. The air switch valve is installed between the barrel and the air chamber. The hammer assembly includes a hammer disposed corresponding to the air switch valve and a return spring flexibly held between the gun body and the hammer. The hammer can selectively push against or release the air switch valve. The delivery tube is moveably sleeved around the barrel and has a toggleable grip exposed out of the gun body and a push element movable among the barrel, the magazine, and the hammer. The push element can selectively push against the hammer or the cartridge to the barrel or to be crammed between the barre and the magazine. The trigger assembly includes a trigger member and a hammer latch, both pivoted to the gun body. The trigger member can selectively drive the hammer latch to press against or release the hammer.

Based on the above description, the toy gun of the present invention further includes a positioning safety assembly. Using the structure and actuating relationship of the positioning safety assembly, the cartridge can be actually loaded to the barrel for the following cocking process to prevent an inadvertent firing before the cartridge is loaded, which improves the operation safety of the toy gun of the present invention.

Based on the above description, the toy gun of the present invention further includes a cocking latch assembly and an anti-reload assembly. Using the structures and actuating relationships of the cocking latch assembly and the anti-reload assembly, pulling the toggleable grip again to reload the cartridge into the barrel can be prevented when the previous cartridge fails to be fired. The toggleable grip cannot be smoothly pulled until the firing process succeeds, which enhances the operation safety of the toy gun of the present invention.

DETAILED DESCRIPTION OF THE INVENTION

Figure 1:
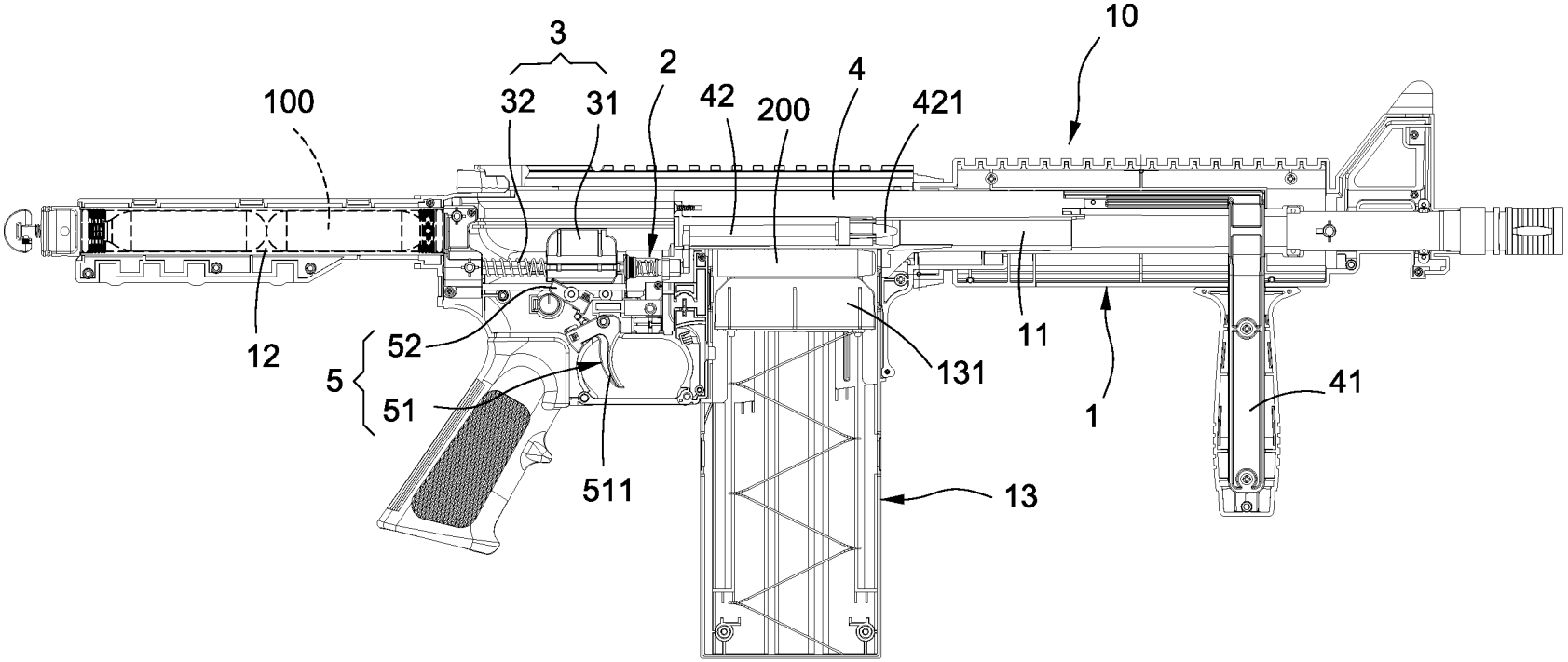
FIG. 1 is a schematic view of the delivery tube of the present invention in the first operating state.

The technical features and details of the present invention are described below in reference to accompanying figures. However, the accompanying figures are only for reference and explanation, but not to limit the scope of the present invention.

Please refer to FIGS. 1-10. The present invention provides a toy gun with a toggleable grip. The toy gun 10 mainly includes a gun body 1, an air switch valve 2, a hammer assembly 3, a delivery tube 4, and a trigger assembly 5.

As shown in FIGS. 1-10, the gun body 1 has a barrel 11, an air chamber 12 connected to the barrel 11, and a magazine 13 connected to the barrel 11. The air bottle 100 is disposed in the air chamber 12 and the cartridge 200 is disposed in the magazine 13. A flexible block 131 is disposed in the magazine 13 and used to press again the cartridge 200 to be crammed between the barrel 11 and the magazine 13.

The air bottle 100 disposed in the air chamber 12 is pierced such that the gas inside the air bottle 100 flows out and fills the interior of the air chamber 12; in addition, the cartridge 200 is made of non-expanding recreational foam, but not limited to this.

As shown in FIGS. 1-10, the air switch valve 2 is installed between the barrel 11 and the air chamber 12; the air switch valve 2 controls the communication and the isolation between the barrel 11 and the air chamber 12.

As shown in FIGS. 1-10, the hammer assembly 3 includes a hammer 31 disposed corresponding to the air switch valve 2 and a return spring 32 flexibly held between the gun body 1 and the hammer 31; the hammer 31 can selectively push against or release the air switch valve 2. The return spring 32 is used to drive the hammer 31 to return toward the air switch valve 2.

As shown in FIGS. 1-10, the delivery tube 4 is moveably sleeved around the barrel 11; the delivery tube 4 has a toggleable grip 41 exposed out of the gun body 1 and a push element 42 movable among the barrel 11, the magazine 13, and the hammer 31. A tip portion 421 capable of pushing against the cartridge 200 is disposed at one end of the push element 42 and a protrusion 422 is disposed at the other end of the push element 42. The push element 42 can selectively push against the hammer 31 or the cartridge 200 to the barrel 11 or to be crammed between the barrel 11 and the magazine 13.

When the push element 42 pushes against the hammer 31 (i.e., the push element 42 is not crammed between the barrel 11 and the magazine 13), the flexible block 131 presses against the cartridge 200 to be crammed between the barrel 11 and the magazine 13. After that, when the push element 42 moves away from the hammer 31 to be crammed between the barrel 11 and the magazine 13, the push element 42 will push against the cartridge 200 to the interior the barrel 11.

As shown in FIGS. 1-10, the trigger assembly 5 includes a trigger member 51 and a hammer latch 52, both pivoted to the gun body 1; the trigger member 51 can selectively drive the hammer latch 52 to press against or release the hammer 31.

The detailed description is given below. The trigger member 51 includes a trigger 511, a trigger linkage 512 pivoted to the trigger 511, and a first return spring 513 flexible held between the trigger 511 and the trigger linkage 512. The first return spring 513 is used to drive the trigger linkage 512 to return away from the hammer latch 52. One end of the trigger linkage 512 is provided with a slot 5121 and the other end of the trigger linkage 512 is connected to a release pin 5122 which can selectively push against or release the hammer latch 52.

Figure 5:
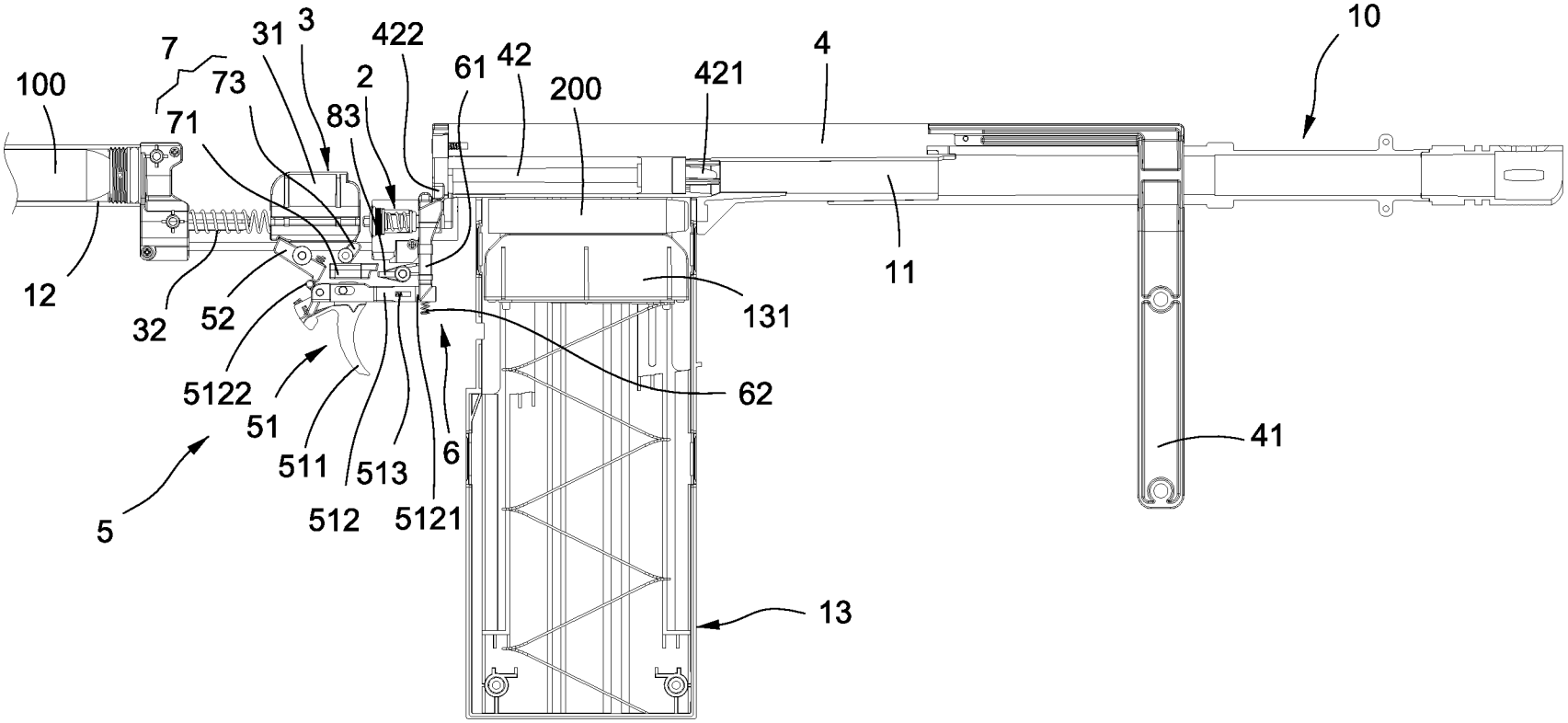
FIG. 5 is a schematic view of the positioning safety assembly of the present invention in the first operating state.
Figure 6:
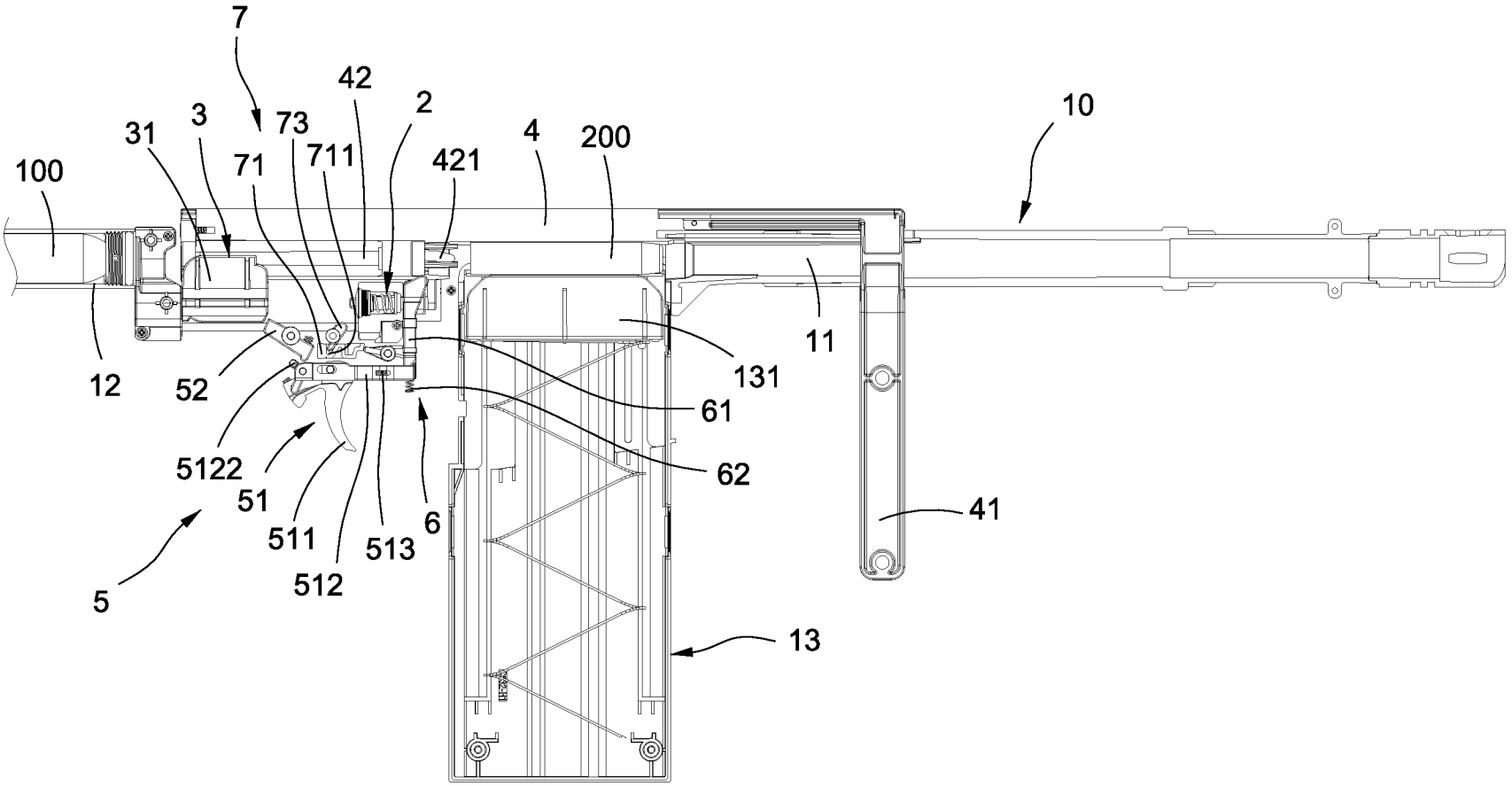
FIG. 6 is a schematic view of the positioning safety assembly of the present invention in the second operating state.
Figure 7:
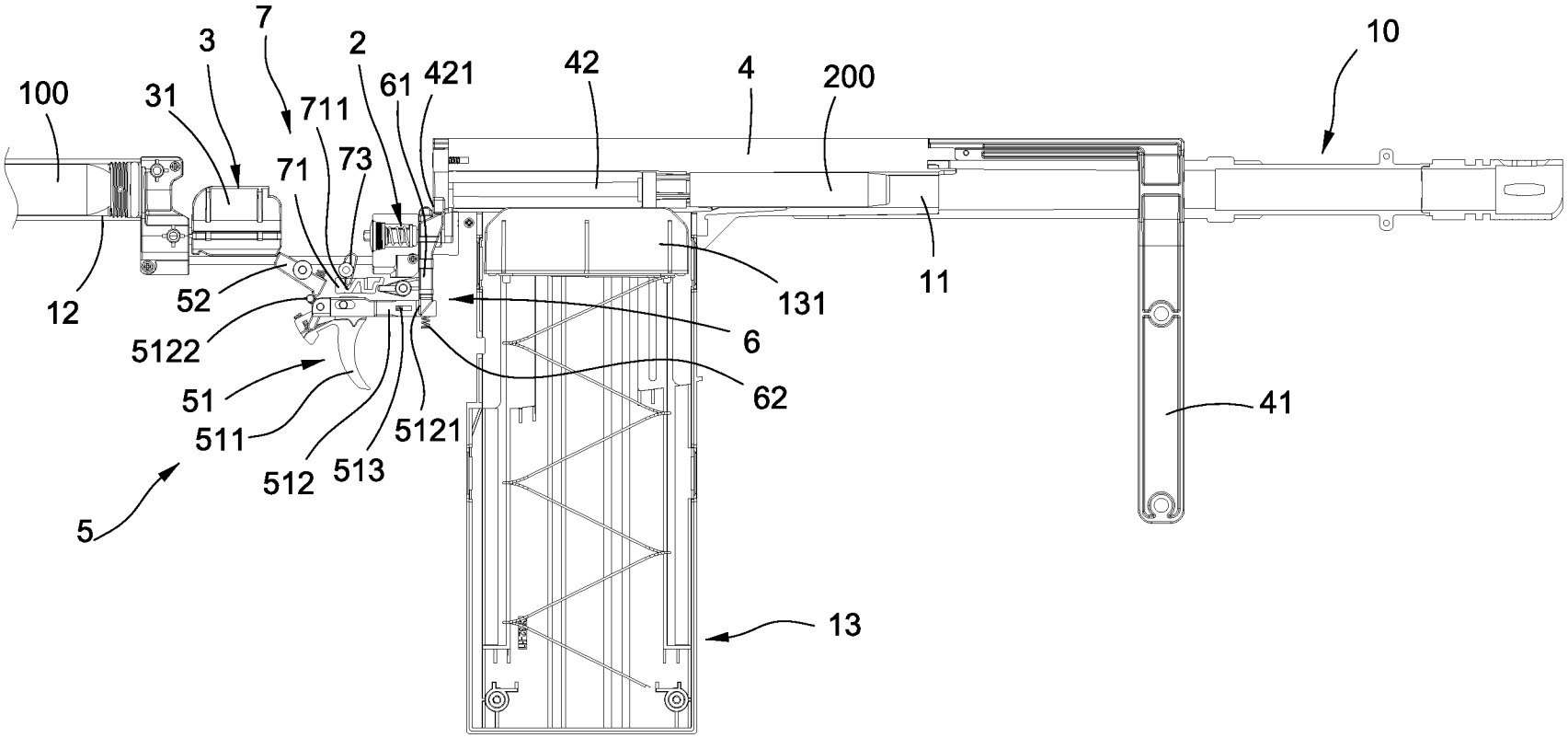
FIG. 7 is a schematic view of the positioning safety assembly of the present invention in the third operating state.

As shown in FIGS. 5-7, the toy gun 10 of the present invention further includes a positioning safety assembly 6. The positioning safety assembly 6 includes a positioning safety pin 61 disposed between the magazine 13 and the air switch valve 2 and a second return spring 62 flexibly held between the gun body 1 and the positioning safety pin 61. The protrusion 422 can selectively press against or release the top of the positioning safety pin 61. The bottom of the positioning safety pin 61 can be selectively latched to or released from the slot 5121. The second return spring 62 is used to drive the bottom of the positioning safety pin 61 to be released from the slot 5121 to make the positioning safety pin 61 return.

As shown in FIGS. 5-10, the toy gun 10 of the present invention further includes a cocking latch assembly 7 having a cocking latch 71 disposed on a side of the hammer 31, a third return spring 72 flexibly held between the gun body 1 and the cocking latch 71, and a cocking latch linkage 73 pivoted to the gun body 1 and disposed between the hammer 31 and the cocking latch 71. The cocking latch 71 has a groove 711. One end of the cocking latch linkage 73 is plugged to the groove 711 of the cocking latch 71 to drive the cocking latch 71; the other end of the cocking latch linkage 73 can be selectively pressed against or released by the hammer 31. The third return spring 72 is used to drive the cocking latch 71 to press against and make the anti-reload lever 83 return.

Figure 8:
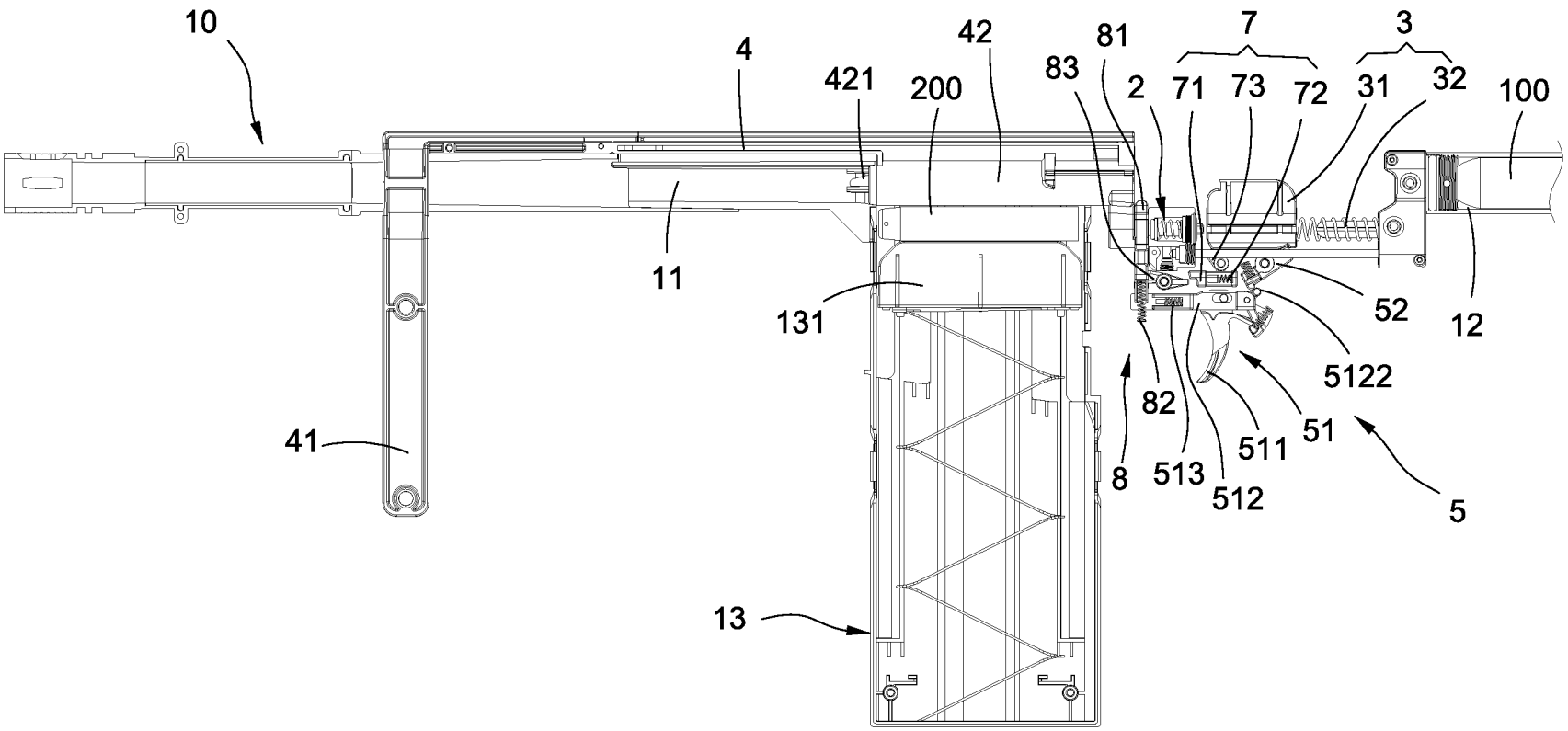
FIG. 8 is a schematic view of the cocking latch assembly and the anti-reload assembly of the present invention in the first operating state.
Figure 9:
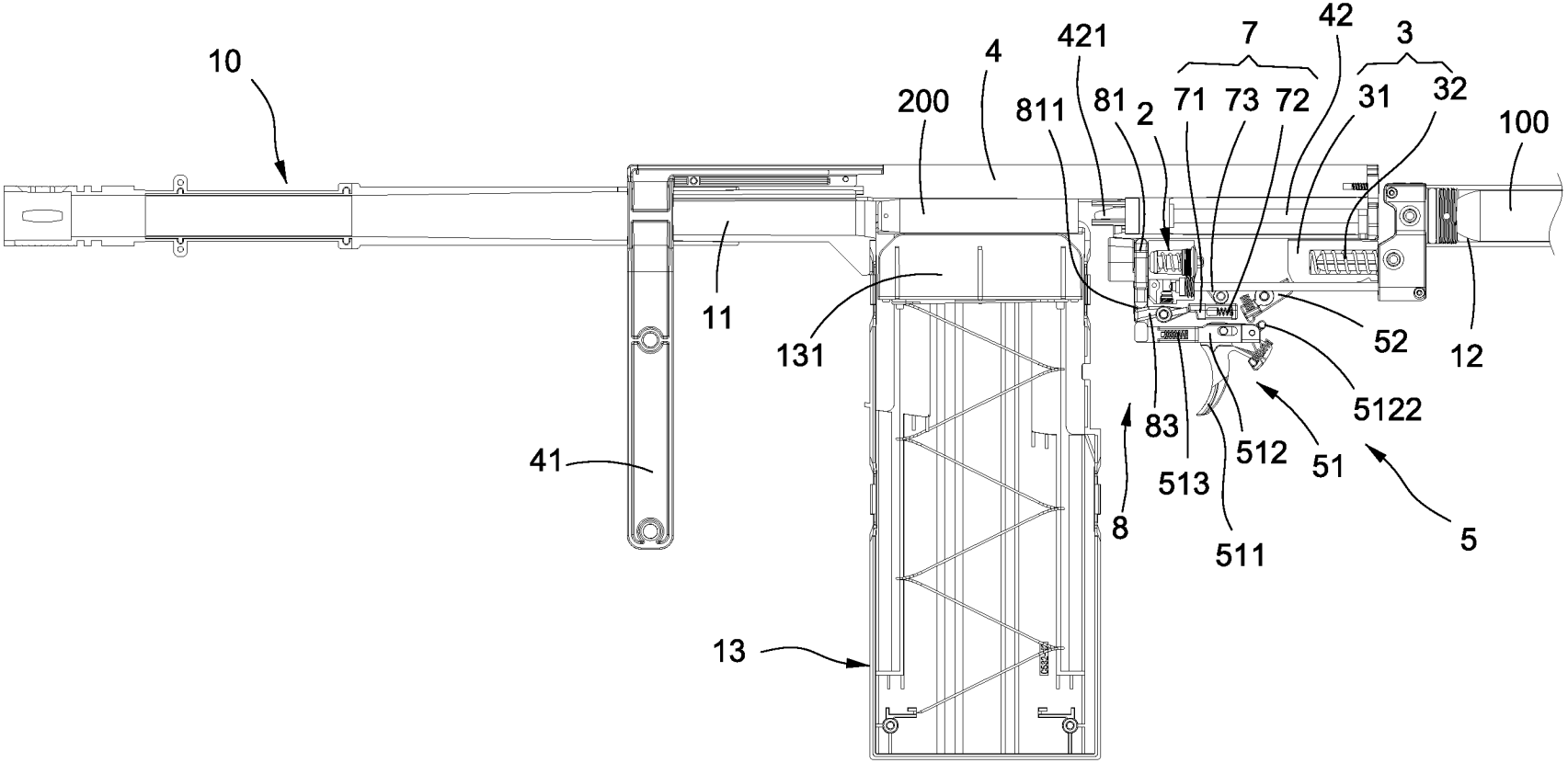
FIG. 9 is a schematic view of the cocking latch assembly and the anti-reload assembly of the present invention in the second operating state.
Figure 10:
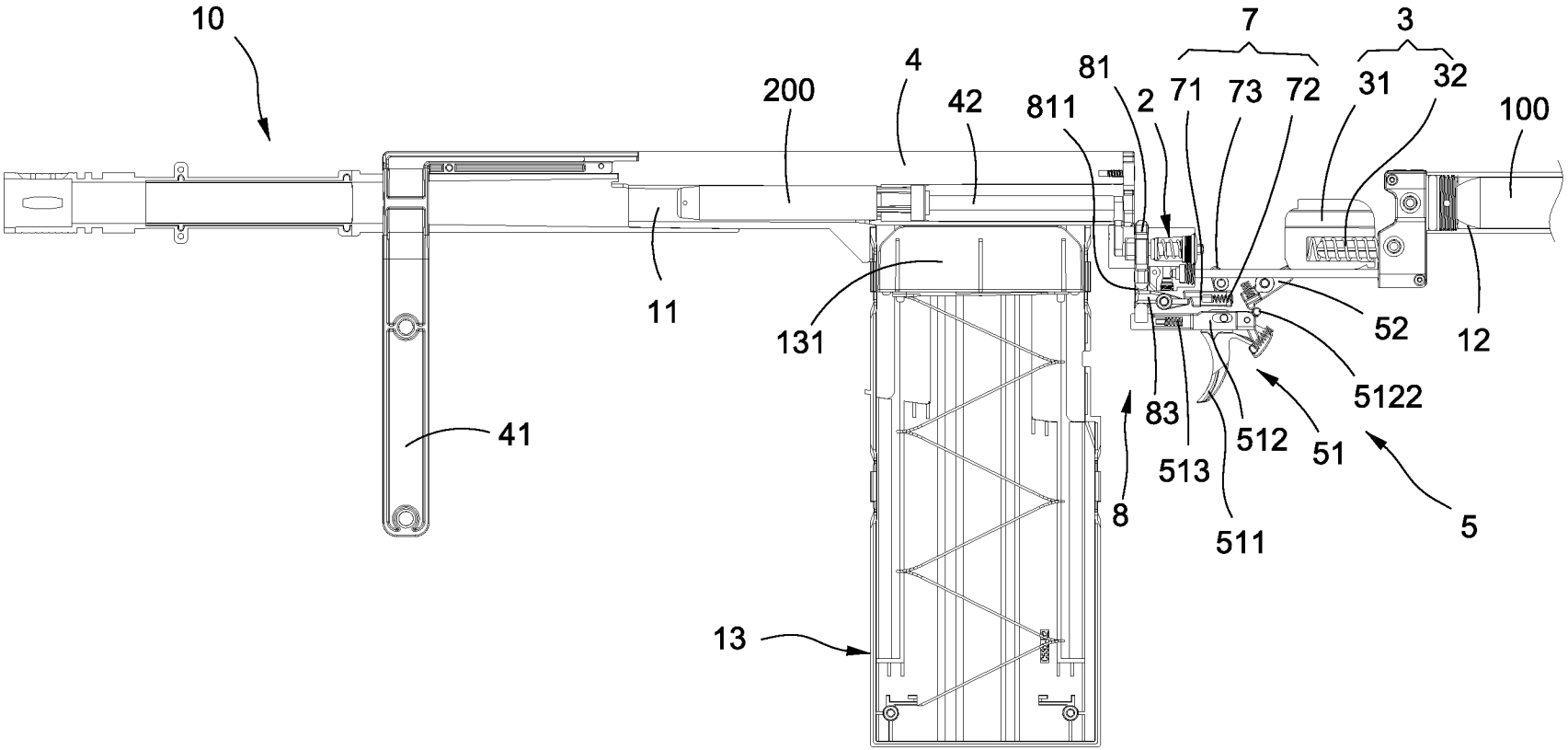
FIG. 10 is a schematic view of the cocking latch assembly and the anti-reload assembly of the present invention in the third operating state.

As shown in FIGS. 8-10, the toy gun 10 of the present invention further includes an anti-reload assembly 8. The anti-reload assembly 8 has an anti-reload pin 81 disposed between the magazine 13 and the air switch valve 2, a fourth return spring 82 flexibly held between the gun body 1 and the anti-reload pin 81, and an anti-reload lever 83 pivoted to the gun body 1 and disposed between the cocking latch 71 and the anti-reload pin 81. The anti-reload pin 81 has an opening 811. One end of the anti-reload lever 83 is plugged to the opening 811 of the anti-reload pin 81 to drive the anti-reload pin 81 and the other end of the anti-reload lever 83 can be selectively pressed against or released by the cocking latch 71. The anti-reload pin 81 can selectively stop or release the push element 42.

Please refer to FIGS. 1-4, which show the operating states of the delivery tube 4 of the present invention. Firstly, as shown in FIG. 1, the air switch valve 2 controls the barrel 11 to be isolated from the air chamber 12 such that the air inside the air chamber 12 cannot flow into the barrel 11 and the push element 42 is crammed between the barrel 11 and the magazine 13. Thus, the flexible block 131 cannot press against the cartridge 200 to be crammed between the barrel 11 and the magazine 13.

Figure 2:
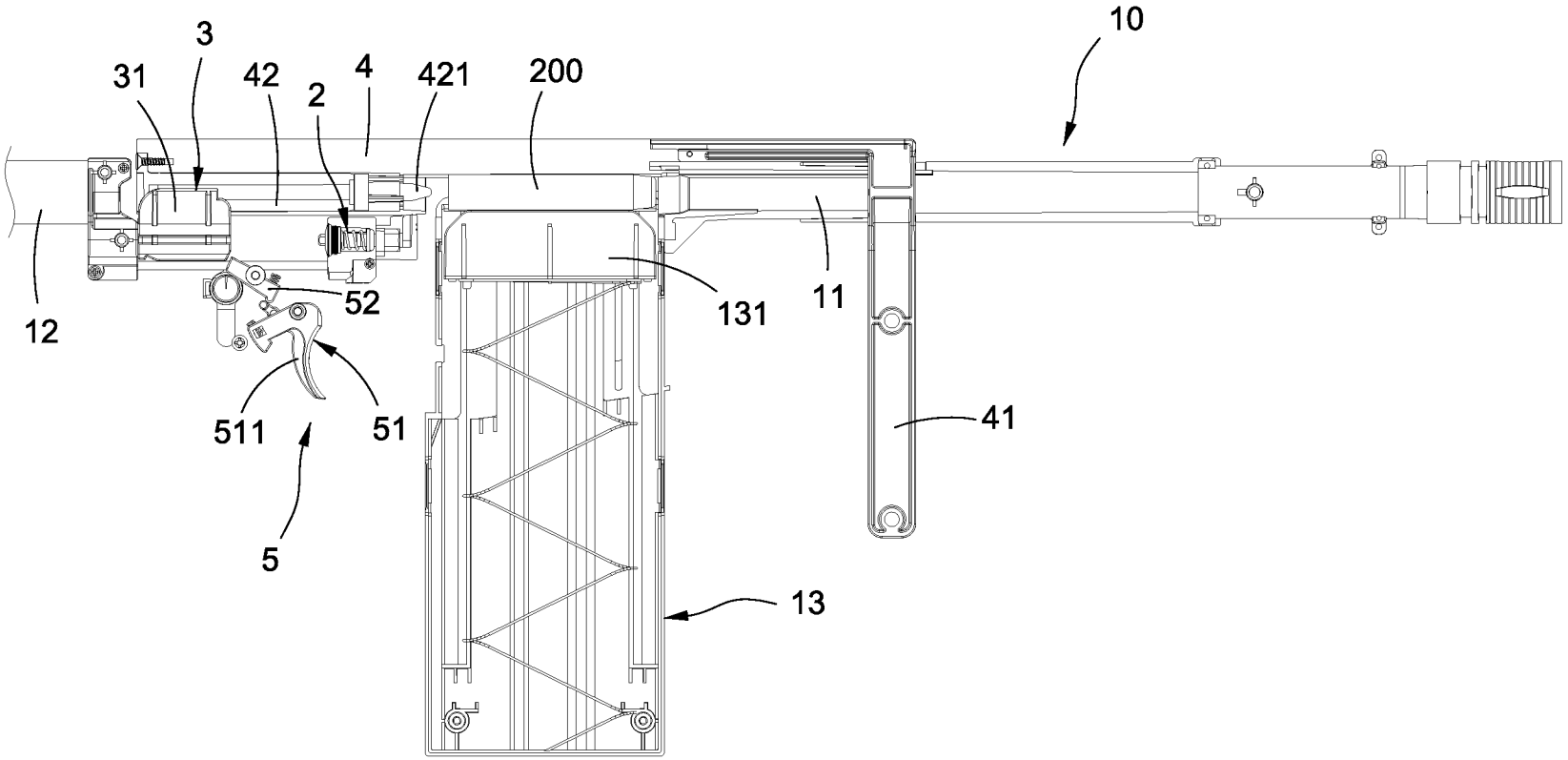
FIG. 2 is a schematic view of the delivery tube of the present invention in the second operating state.

Further, as shown in FIG. 2, the user pulls the toggleable grip 41 towards the trigger assembly 5. At the same time, the push element 42 is driven to push against the hammer 31 away from the air switch valve 2 such that the hammer latch 52 presses against the hammer 31. Because the push element 42 is not crammed between the barrel 11 and the magazine 13, the flexible block 131 will press against the cartridge 200 to be crammed between the barrel 11 and the magazine 13.

Figure 3:
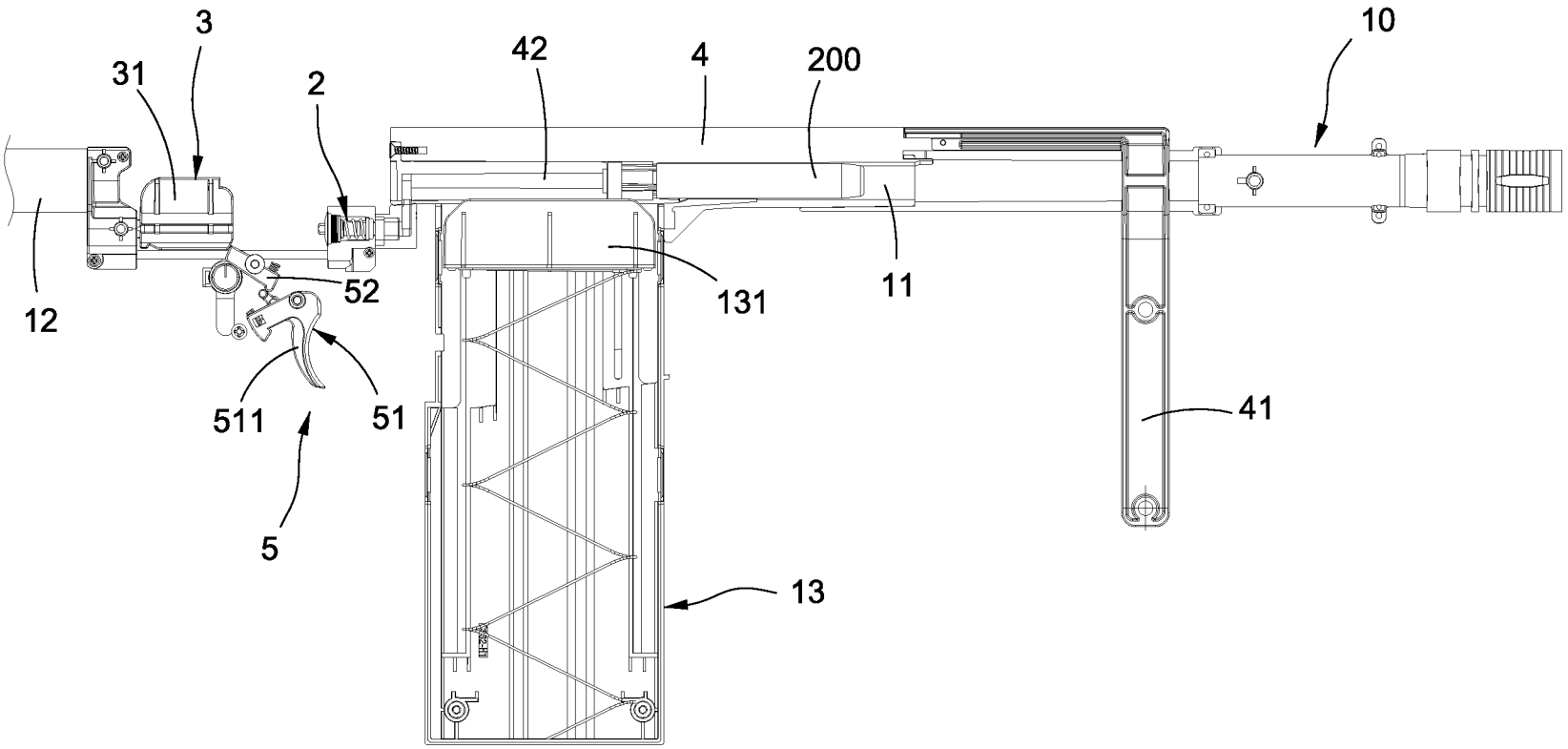
FIG. 3 is a schematic view of the delivery tube of the present invention in the third operating state.

In addition, as shown in FIG. 3, the user can draw the toggleable grip 41 towards the muzzle of the barrel 11. At the same time, the push element 42 is driven to move away from the hammer 31 to the position between the barrel 11 and the magazine 13 and thus to press against the cartridge 200 to the interior of the barrel 11.

Figure 4:
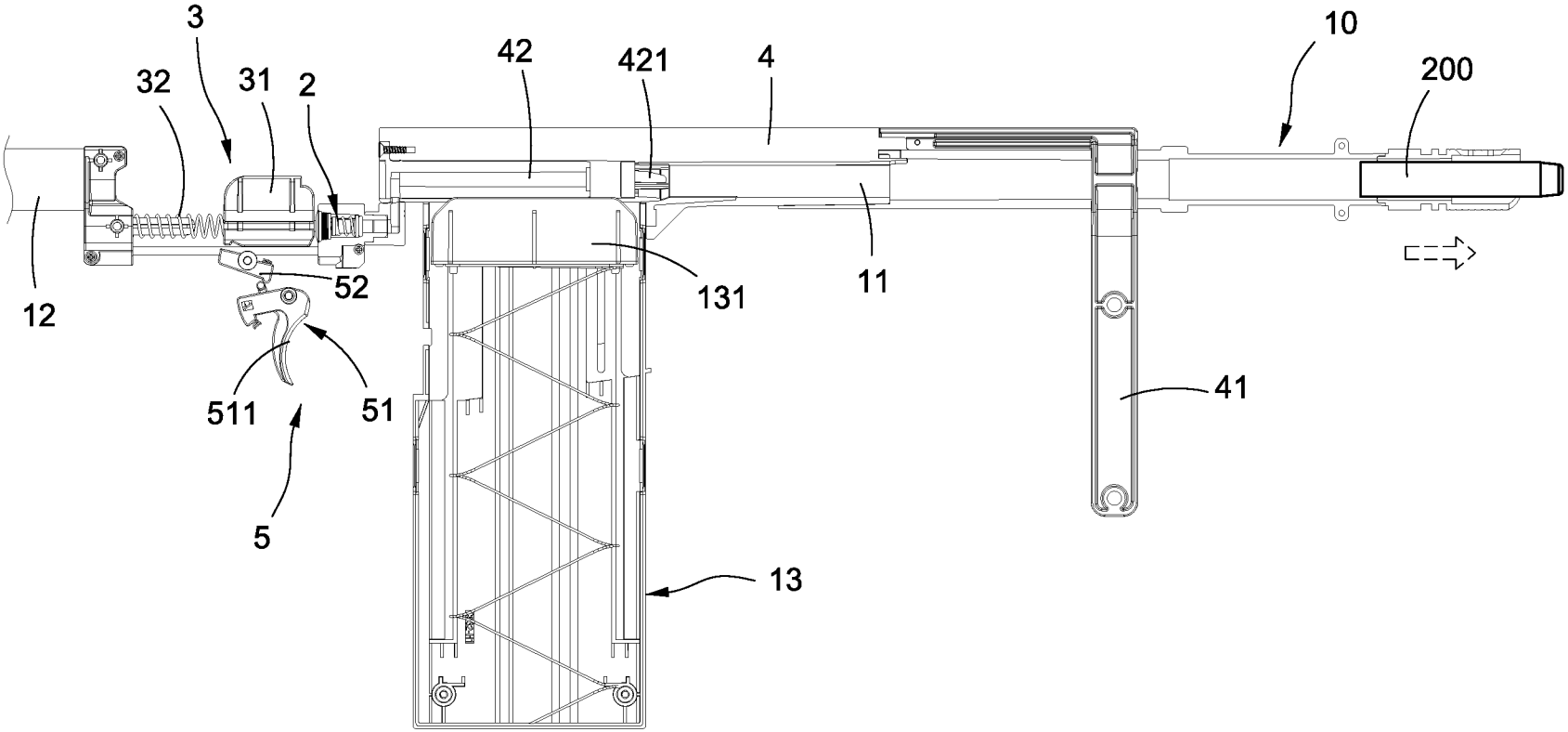
FIG. 4 is a schematic view of the delivery tube of the present invention in the fourth operating state.

Finally, as shown in FIG. 4, when the user pulls the trigger member 51, the trigger member 51 drives the hammer latch 52 to release the hammer 31. Then, the return spring 32 drives the hammer 31 to push against the air switch valve 2. When hit, the air switch valve 2 controls the barrel 11 to communicate with the air chamber 12 to release the air inside the air chamber 12 to flow into the barrel 11. As a result, the cartridge 200 is pulled out of the barrel 11 to complete one shot.

In this way, the toggleable grip 41 of the delivery tube 4 of the present invention can move back and forth with respect to the barrel 11 and the push element 42 of the delivery tube 4 can selectively push against the hammer 31 or the cartridge 200 to the barrel 11. Such a design makes the toggleable grip 41 similar to the vertical foregrip of a genuine gun in appearance and operation, which enables the toy gun 10 of the present invention to have very realistic features.

Please refer to FIGS. 5-7, which show the operating states of the positioning safety assembly 6 of the present invention. Firstly, as shown in FIG. 5, when the push element 42 is crammed between the barrel 11 and the magazine 13, the protrusion 422 presses against the top of the positioning safety pin 61 and the bottom of the positioning safety pin 61 is latched to the slot 5121 to drive the trigger linkage 512 to move towards the hammer latch 52 such that the release pin 5122 pushes against the hammer latch 52. However, at this moment, the hammer latch 52 releases the hammer 31 so the hammer 31 cannot be cocked even the user pulls the trigger member 51.

Moreover, as shown in FIG. 6, the user can pull the toggleable grip 41 towards the trigger assembly 5 to drive the push element 42 to push against the hammer 31 away from the air switch valve 2 and thus the hammer latch 52 presses against the hammer 31. Meanwhile, when the protrusion 422 releases the top of the positioning safety pin 61, the second return spring 62 will drive the bottom of the positioning safety pin 61 to be released from the slot 5121. The first return spring 513 drives the trigger linkage 512 to move away from the hammer latch 52 such that the release pin 5122 releases the hammer latch 52. However, at this moment, the release pin 5122 releases the hammer latch 52 and the trigger member 51 cannot drive the hammer latch 52 so the hammer 31 cannot be cocked even the user pulls the trigger member 51.

In addition, as shown in FIG. 7, the user can draw the toggleable grip 41 towards the muzzle of the barrel 11 to drive the push element 42 to be crammed between the barrel 11 and the magazine 13; the push element 42 also pushes against the cartridge 200 to the interior of the barrel 11. At the same time, the protrusion 422 presses against the top of the positioning safety pin 61 again and the bottom of the positioning safety pin 61 is latched to the slot 5121 to drive the trigger linkage 512 to move towards the hammer latch 52 such that the release pin 5122 pushes against the hammer latch 52. Currently, the hammer latch 52 presses against the hammer 31. When the user pulls the trigger member 51, the trigger member 51 releases the release pin 5122 to drive the hammer latch 52 to release the hammer 31 to allow a firing.

Thus, using the structure and actuating relationship of the positioning safety assembly 6, the push element 42 is crammed between the barrel 11 and the magazine 13 and pushes against the cartridge 200 to the interior of the barrel 11. That is, the cartridge 200 is actually loaded to the barrel and then the trigger member 51 can be pulled for the cocking process to prevent an inadvertent firing before the cartridge 200 is loaded, which improves the operation safety of the toy gun 10 of the present invention.

Please refer to FIGS. 8-10, which show the operating states of the cocking latch assembly 7 and the anti-reload assembly 8 of the present invention. Firstly, as shown in FIG. 8, the push element 42 is crammed between the barrel 11 and the magazine 13. When the hammer latch 52 releases the hammer 31, the hammer 31 presses against the cocking latch linkage 73. Because one end of the cocking latch linkage 73 is plugged to the cocking latch 71 which is driven to release the anti-reload lever 83, the anti-reload pin 81 is not constrained by external force. In this way, the fourth return spring 82 can drive the anti-reload pin 81 to release the push element 42.

Furthermore, as shown in FIG. 9, the user can pull the toggleable grip 41 towards the trigger assembly 5. Because the anti-reload pin 81 is currently constrained only by the fourth return spring 82, the push element 42 can easily strike the anti-reload pin 81 away to push against the hammer 31 to move away from the air switch valve 2 such that the hammer latch 52 presses against the hammer 31.

Besides, as shown in FIG. 10, the user can draw the toggleable grip 41 towards the muzzle of the barrel 11; the push element 42 is driven to be crammed between the barrel 11 and the magazine 13 and to press against the cartridge 200 to the interior of the barrel 11. At the same time, the hammer latch 52 presses against the hammer 31 to release the cocking latch linkage 73; the third return spring 72 drives the cocking latch 71 to press against the anti-reload lever 83 such that the anti-reload lever 83 drives the anti-reload pin 81 to stop the push element 42. Thus, when the hammer latch 52 presses against the hammer 31, the push element 42 is stopped by the anti-reload pin 81, which prevents the user from moving the toggleable grip 41.

In this way, the user cannot pull the trigger member 51 for the cocking process. That is, when the hammer latch 52 presses against the hammer 31, the push element 42 is stopped by the anti-reload pin 81 and the toggleable grip 41 cannot be moved simultaneously, which prevents the push element 42 from pushing against the cartridge 200 to the interior of the barrel 11 again. Also, the unfired cartridge 200, which is reloaded into the barrel 11 by pulling the toggleable grip 41 again to make the cartridges 200 in the barrel 11 stuck or misaligned with each other and not fired or partially fired, can be avoided. The toggleable grip 41 cannot be pulled until the user pulls the trigger member 51 for the cocking process (i.e., the hammer latch 52 releases the hammer 31.), which improves the operation safety of the toy gun 10 of the present invention.

In summary, the toy gun with a toggleable grip of the present invention can achieve the expected objectives and overcome the disadvantages of the prior art. Also, it is indeed novel, useful, and non-obvious to be patentable. Please examine the application carefully and grant it as a formal patent for protecting the rights of the inventor.

What is claimed is:

1. A toy gun with a toggleable grip, used with an air bottle and a cartridge, the toy gun including:

a gun body having a barrel, an air chamber connected to the barrel, and a magazine connected to the barrel, wherein the air bottle is disposed in the air chamber and the cartridge is disposed in the magazine;

an air switch valve installed between the barrel and the air chamber;

a hammer assembly including a hammer disposed corresponding to the air switch valve and a return spring flexibly held between the gun body and the hammer, wherein the hammer can selectively push against or release the air switch valve;

a delivery tube moveably sleeved around the barrel and having a toggleable grip exposed out of the gun body, and a push element movable among the barrel, the magazine, and the hammer, wherein the push element can selectively push against the hammer, or push the cartridge to the barrel, or be crammed between the barrel and the magazine;

a trigger assembly including a trigger member and a hammer latch, both pivoted to the gun body, wherein the trigger member can selectively drive the hammer latch to press against or release the hammer, wherein the trigger member includes a trigger, a trigger linkage pivoted to the trigger, and a first return spring flexibly held between the trigger and the trigger linkage; and a positioning safety assembly including a positioning safety pin which is disposed between the magazine and the air switch valve, and a second return spring flexibly held between the gun body and the positioning safety pin, wherein a tip portion capable of pushing against the cartridge is disposed at one end of the push element, and a protrusion is disposed at the other end of the push element, and the protrusion can selectively press against or release a top of the positioning safety pin.

2. The toy gun with a toggleable grip according to claim 1, wherein when the hammer is pushed by the push element to move away from the air switch valve, the hammer latch presses against the hammer and the cartridge is crammed between the barrel and the magazine.

3. The toy gun with a toggleable grip according to claim 2, wherein the trigger member drives the hammer latch to release the hammer, such that the hammer is driven by the return spring to push against the air switch valve.

4. The toy gun with a toggleable grip according to claim 1, wherein one end of the trigger linkage is provided with a slot, and the other end of the trigger linkage is connected to a release pin, wherein a bottom of the positioning safety pin can be selectively latched to or released from the slot, wherein the release pin can selectively push against or release the hammer latch.

5. The toy gun with a toggleable grip according to claim 4, wherein when the protrusion releases the top of the positioning safety pin, the bottom of the positioning safety pin is driven by the second return spring to be released from the slot, and the trigger linkage is driven by the first return spring to move away from the hammer latch such that the release pin releases the hammer latch.

6. The toy gun with a toggleable grip according to claim 4, wherein the push element is crammed between the barrel and the magazine, and the protrusion presses against the top of the positioning safety pin, and the bottom of the positioning safety pin is latched to the slot to move the trigger linkage in the direction close to the hammer latch such that the release pin pushes against the hammer latch.

7. The toy gun with a toggleable grip according to claim 1, further including a cocking latch assembly having a cocking latch disposed on a side of the hammer, and a third return spring flexibly held between the gun body and the cocking latch, and a cocking latch linkage pivoted to the gun body and disposed between the hammer and the cocking latch, wherein one end of the cocking latch linkage is plugged to the cocking latch and the other end can be selectively pressed against or released by the hammer.

8. The toy gun with a toggleable grip according to claim 7, further including an anti-reload assembly having an anti-reload pin disposed between the magazine and the air switch valve, and a fourth return spring flexibly held between the gun body and the anti-reload pin, and an anti-reload lever pivoted to the gun body and disposed between the cocking latch and the anti-reload pin, wherein one end of the anti-reload lever is plugged to the anti-reload pin, and the other end can be selectively pressed against or released by the cocking latch, wherein the anti-reload pin can selectively stop or release the push element.

9. The toy gun with a toggleable grip according to claim 8, wherein when the hammer latch releases the hammer, the hammer presses against the cocking latch linkage which drives the cocking latch to release the anti-reload lever, such that the fourth return spring drives the anti-reload pin to release the push element.

10. The toy gun with a toggleable grip according to claim 8, wherein when the hammer latch presses against the hammer, the hammer releases the cocking latch linkage, and the third return spring drives the cocking latch to press against the anti-reload lever, such that the anti-reload lever drives the anti-reload pin to stop the push element.

* * * * *